US012070110B2

(12) United States Patent
Rosen et al.

(10) Patent No.: US 12,070,110 B2
(45) **Date of Patent: *Aug. 27, 2024**

(54) OPTICAL INSTRUMENT CASE WITH LOW PROFILE LID AND HARNESS FOR THE SAME

(71) Applicant: Sheltered Wings, Inc., Barneveld, WI (US)

(72) Inventors: Michael Rosen, Barneveld, WI (US); David Hamilton, Barneveld, WI (US); Rob Morell, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/699,538

(22) Filed: Mar. 21, 2022

(65) Prior Publication Data

US 2022/0211153 A1 Jul. 7, 2022

Related U.S. Application Data

(63) Continuation of application No. 16/690,781, filed on Nov. 21, 2019, now Pat. No. 11,284,691.

(60) Provisional application No. 62/770,243, filed on Nov. 21, 2018.

(51) Int. Cl.
*A45C 11/08* (2006.01)
*A45F 3/14* (2006.01)

(52) U.S. Cl.
CPC ..... *A45C 11/08* (2013.01); *A45F 3/14* (2013.01); *A45F 2003/146* (2013.01)

(58) Field of Classification Search
CPC ..... A45C 11/08; A45F 3/14; A45F 2003/146
USPC ..... 224/623
See application file for complete search history.

(56) References Cited

U.S. PATENT DOCUMENTS

| | | | | |
|---|---|---|---|---|
| 4,033,488 | A | 7/1977 | Brewer | |
| 4,232,808 | A | 11/1980 | Gray | |
| D271,540 | S * | 11/1983 | Williams | D3/294 |
| 4,865,191 | A | 9/1989 | Easter | |
| 5,016,797 | A | 5/1991 | Rowledge | |
| 5,320,261 | A * | 6/1994 | Andersen | A45F 5/00 224/269 |
| 5,360,149 | A | 11/1994 | Lucot | |
| 5,816,464 | A * | 10/1998 | Seiler | A45F 5/00 224/257 |
| 6,095,328 | A * | 8/2000 | Smithbaker, III | A45C 11/08 206/316.3 |
| 7,036,943 | B1 * | 5/2006 | Brewer | G02B 23/18 359/511 |

(Continued)

FOREIGN PATENT DOCUMENTS

| | | | |
|---|---|---|---|
| FR | 2853576 | A1 | 10/2004 |
| KR | 20110003232 | U | 3/2011 |

*Primary Examiner* — Peter N Helvey
(74) *Attorney, Agent, or Firm* — Husch Blackwell LLP

(57) ABSTRACT

A case for an optical instrument is provided. The case has a body with a bottom and two pairs of oppositely disposed side walls connected to the body forming a cavity. The case also includes a lid having a top cover and two pairs of oppositely disposed side portions, each of which corresponds with and overlaps a corresponding side wall of the body when the lid is in a closed position. A first pair of the two pairs of side walls each includes an elastic chord which connects the given side wall to the corresponding side portion of the lid.

9 Claims, 17 Drawing Sheets

(56) References Cited

U.S. PATENT DOCUMENTS

| | | | | |
|---|---|---|---|---|
| 7,059,503 | B2 * | 6/2006 | Andersen | A45F 3/14 224/648 |
| D601,341 | S * | 10/2009 | Arman | D3/263 |
| 8,132,669 | B1 * | 3/2012 | Stubel | A45C 11/08 206/316.3 |
| 8,720,681 | B1 | 5/2014 | Hancock et al. | |
| 9,210,978 | B1 | 12/2015 | Hunt | |
| 9,332,822 | B2 | 5/2016 | Hunt | |
| 9,492,004 | B1 | 11/2016 | Young | |
| 9,872,553 | B1 | 1/2018 | Erlandson | |
| 11,470,949 | B2 * | 10/2022 | Racicot | A45C 11/08 |
| 2004/0140335 | A1 * | 7/2004 | Hancock | A45F 3/14 224/648 |
| 2006/0151563 | A1 * | 7/2006 | Bussard | A45F 5/00 224/664 |
| 2008/0061099 | A1 | 3/2008 | Tilby | |
| 2009/0046365 | A1 | 2/2009 | Moore | |
| 2009/0184143 | A1 | 7/2009 | Witt et al. | |
| 2014/0224851 | A1 * | 8/2014 | Hancock | B60R 9/02 224/401 |
| 2014/0231482 | A1 | 8/2014 | Chamberlayne | |
| 2021/0015228 | A1 | 1/2021 | Burns | |
| 2021/0356233 | A1 * | 11/2021 | Holbrook | A45C 13/02 |
| 2022/0104595 | A1 * | 4/2022 | Ambielli | A45C 5/08 |

* cited by examiner

OPTICAL INSTRUMENT CASE WITH LOW PROFILE LID AND HARNESS FOR THE SAME

CROSS REFERENCE TO RELATED APPLICATION

This application is a continuation patent application of U.S. patent application Ser. No. 16/690,781 filed Nov. 21, 2019, which claims priority to and is a non-provisional patent application of U.S. Provisional Patent Application No. 62/770,243 filed Nov. 21, 2018, which is incorporated herein by reference in its entirety.

FIELD

The disclosure relates to cases optical instruments, and more particularly to a case for binoculars having a low profile lid and which can be connectable to a harness.

BACKGROUND

There are currently a number of cases, packs, and other types of pouches (collectively referred to herein as "cases") available for holding optical instruments, such as binoculars, in place against the chest of user. Such cases generally include the case itself which holds the optical instrument, a harness for securing the case to the user, and, in some cases, additional accessory cases. These cases serve to protect the optical instrument while a user is moving about when the optical instrument is not in use and keep the optical instrument within reach to allow the user to quickly and easily access the optical instrument. The cases therefore generally further include easy to operate covers.

Current cover designs are insufficient when it comes to hassle-free use and safe storage of the optical instrument. For example, when the case is worn on a user's chest, the cover must either open against the user's chest or outwardly away from the user. If the cover is opened toward the user, it can hinder the user's ability to quickly pull the optical instrument out of the case. When the optical instrument has been removed, these covers tend to fall back into place on top of the case. This prevents debris from entering the case as the user walks around, but makes it more difficult to return the optical instrument to the case after use because the user must both hold the optical instrument and manipulate the cover. This creates unnecessary movement and can be an annoyance to the user.

On the other hand, if the cover is opened away from the user, it is out of the way for removing and replacing the optical instrument, but extends from the case thereby creating extra bulk. The open cover projects or dangles from the case and can get caught on brush, trees, and other objects while the user is moving around. The open cover also acts as a bowl and collects dust, dirt, debris and even moisture. If the cover is not thoroughly cleaned before closing the case, the dust, dirt, debris, moisture and anything else caught by the cover is dropped directly on the optical instrument when the cover is closed. This creates a safety concern for the user and may damage the optical instrument.

Accordingly, the need exists for a case for optical instruments that permits easy access and retains a low profile when the cover is in an open position.

SUMMARY

In one embodiment, the disclosure provides a case for an optical instrument. In accordance with embodiments of the disclosure, the case comprises a body having a bottom, two pairs of oppositely disposed side walls connected to the bottom forming a cavity; a lid having a top cover, and two pairs of oppositely disposed side portions, wherein the lid has a closed position and an open position, and wherein the each of the side portions of the two pairs of oppositely disposed side portions corresponds to and overlaps with a corresponding side wall in the closed position; and wherein a first of the two pairs of oppositely disposed side walls each includes an elastic chord connecting the respective side wall to the corresponding side portion of the lid.

In a further embodiment, a case for an optical instrument is provided, the case comprising a body having a generally rectangular bottom, a front side wall, a rear side wall, a right side wall, and a left side wall; and a lid having a top cover, a front side portion, a rear side portion, a right side portion, and a left side portion; wherein the lid has a closed position and an open position; wherein the top cover is in contact with at least a portion of the front side wall, rear side wall, right side wall and left side wall when in the closed position; and wherein the lid is compressed against the front side wall when in the open position.

Other embodiments will be evident from a consideration of the drawings taken together with the detailed description of the invention.

DETAILED DESCRIPTION

The disclosure relates to cases for holding optical instruments and associated harnesses, and more particularly to cases for binoculars having a low profile lid and which can be connectable to a harness. Certain preferred and illustrative embodiments of the invention are described below. The disclosure is not limited to these embodiments.

As used herein, "optical instrument" and related terms refer to any optical viewing device. Non-limiting examples of optical instruments include binoculars, telescopes, sights, microscopes camera, and any other device which processes light waves to enhance an image for viewing.

As used herein, a "stiffening element" refers to a structure which provides rigidness to an otherwise flexible or malleable structure. Non-limiting examples of stiffening elements include plastic structures, layered material, thickened material, paper board, thin metal structure, framework and other such structures.

Figure 5:
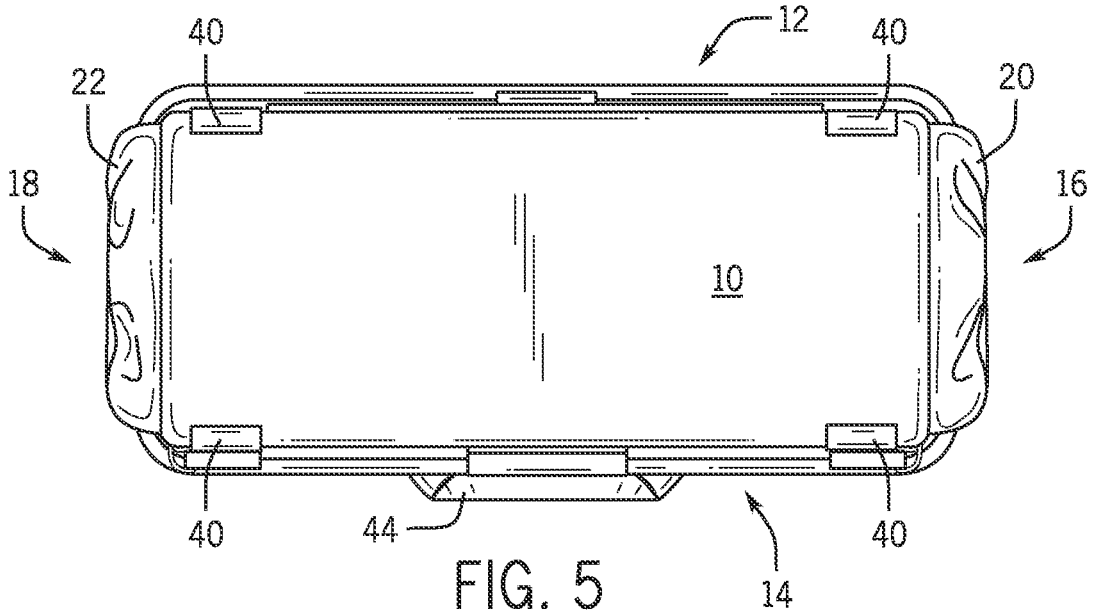
FIG. 5 is a bottom view of the case of FIG. 1.

FIGS. 1-7 illustrate a case for an optical instrument 100 in a closed position in accordance with embodiments of the present disclosure. As shown in FIG. 5, the body 5 of the case 100 includes a bottom 10, which in the embodiment shown is generally rectangular. Two pairs of opposed side walls 12, 14 and 16, 18 (see FIGS. 1-3 and 6-7) are connected to the bottom to form the body 5 of the case 100. While in the embodiment shown the bottom surface 10 is generally rectangular which together with the side walls 12, 14, 16 and 18 form a body 5 having a generally rectangular prism shape. However, it will be appreciated that the bottom 10 may take any variety of shapes, including, but not limited to, square, oval, circle, trapezoid, or other quadrilateral or polygon, with the appropriate number of sides to create the corresponding three-dimensional prism shape.

The bottom 10 and side walls 12, 14, 16 and 18 are made of a durable fabric material, or layers of such materials, which has water repellent and tear resistant properties. Preferably the durable fabric is also lightweight and makes little noise when folded or manipulated. Non-limiting examples of suitable materials include nylon, CORDURA® fabrics, or other similar technical fabric, and combinations of these materials. In some embodiments, one or more of the bottom 10 and side walls 12, 14, 16 and 18 may include one or more stiffener elements. Providing one or more stiffening elements with one or more of the bottom 10 and/or side walls 12, 14, 16 and 18 results in a case 100 having additional shape and support to hold an optical instrument. In a preferred embodiment, the bottom 10 includes one or more stiffening elements, and preferably a single stiffening element, which is a single panel of a rigid material (e.g., plastic) within the material of the bottom 10.

In an embodiment, one of more of the bottom 10 and side walls 12, 14, 16 and 18 may further include a padding material, such as fibrous/resinous material (e.g., cotton, polyester, etc.).

It will be appreciated that the particular dimensions of the bottom 10 can vary by convenience; however, in the embodiment shown, the bottom 10 is rectangular with an approximate length from 5.0 inches, or 5.5 inches, or 6.0 inches, or 6.25 inches to 6.5 inches, or 6.75 inches, or 7.0 inches, or 7.5 inches, or 8.0 and an approximate width from 3.0 inches, or 3.25 inches, or 3.5 inches, or 3.75 inches to 4.0 inches, or 4.25 inches, or 4.5 inches, or 4.75 inches, or 5.0 inches.

Figure 1:
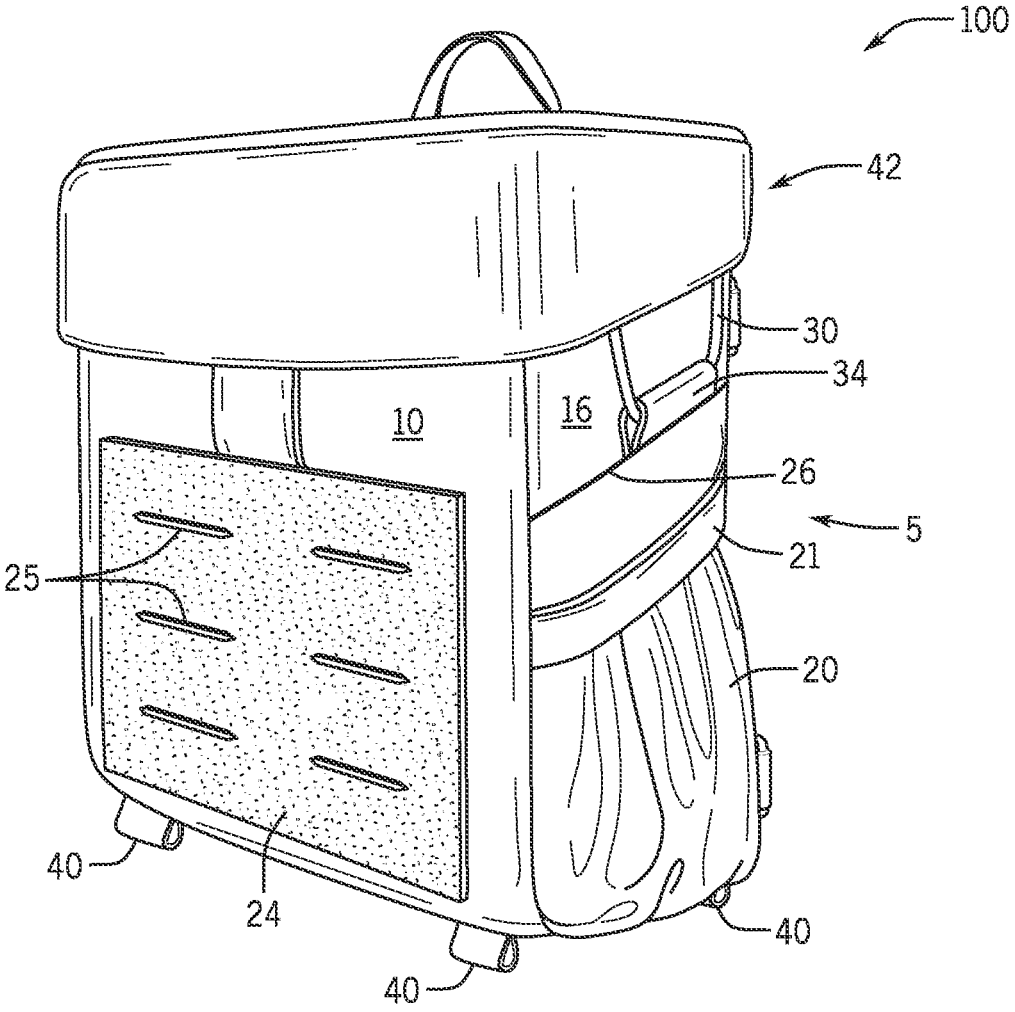
FIG. 1 is an isometric view of a case for an optical instrument in accordance with embodiments of the present disclosure with the cover in the closed position.
Figure 2:
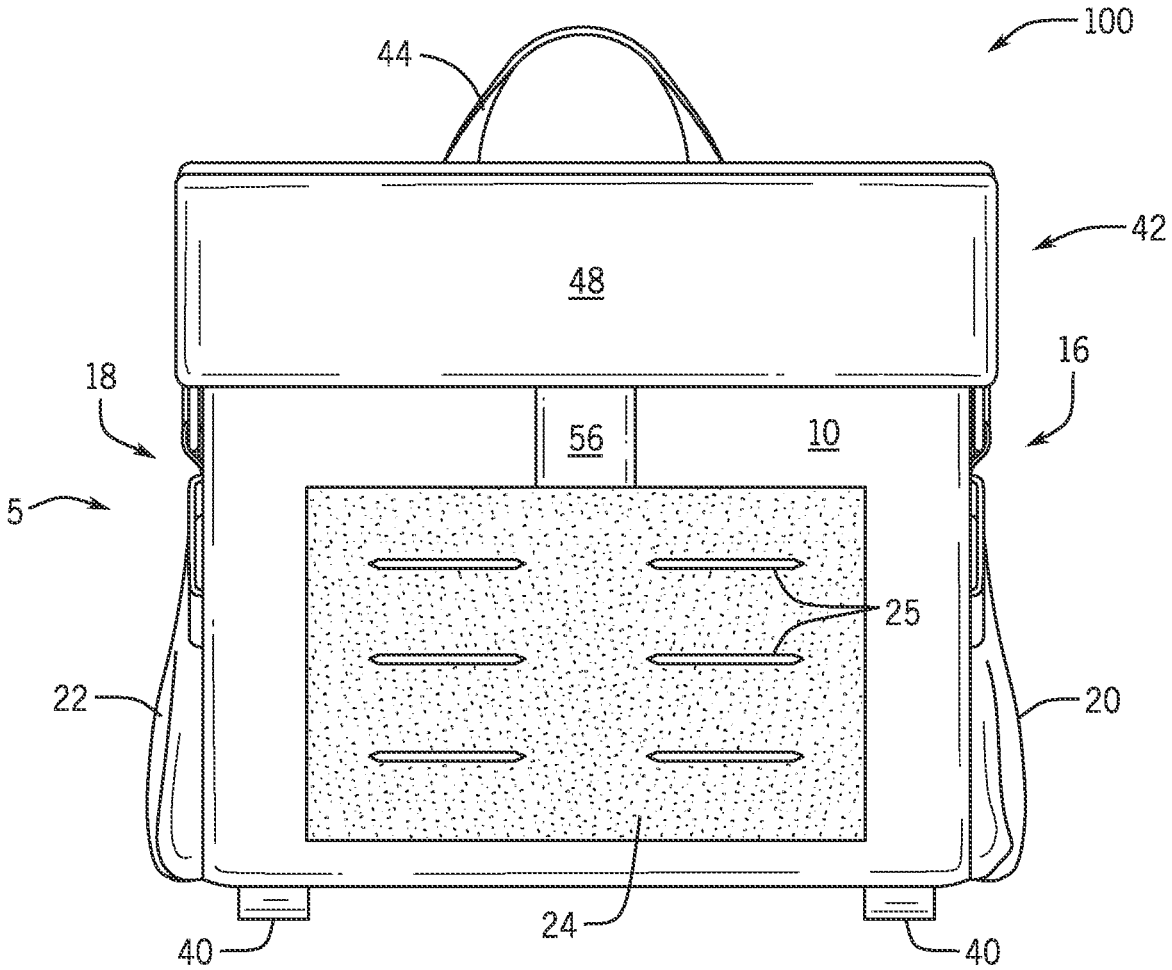
FIG. 2 is a front view of the case of FIG. 1.

As shown in FIGS. 1-2, the front side wall 12 is generally rectangular; although, as discussed above, the front side wall 12 may take any shape depending on the overall desired shape of the body 5. In the embodiment shown, the front side wall 12 is from approximately 5.0 inches, or 5.5 inches, or 6.0 inches, or 6.25 inches to 6.5 inches, or 6.75 inches, or 7.0 inches, or 7.5 inches, or 8.0 inches in height and from approximately 5.0 inches, or 5.5 inches, or 6.0 inches, or 6.25 inches to 6.5 inches, or 6.75 inches, or 7.0 inches, or 7.5 inches, or 8.0 inches in width.

The front side wall 12 further includes an attachment panel 24 having a plurality of slits 25 through which a strap or other fastener may be passed to secure accessories to the front side wall 12. In the particular embodiment shown, the attachment panel 24 is made of hook-and-loop material with the loop portion of the material exposed. Further, as shown in FIGS. 1-2, the attachment panel 24 includes six slits 25. In further embodiments, the attachment panel 24 may be omitted or be made of a different material with a different structure/arrangement to facilitate the attachment of accessories to the case 100. For example, in alternative embodiments, the attachment panel 24 may comprise a plurality of loops, clasps or other structures which engage accessories to secure them to the case 100.

Figure 3:
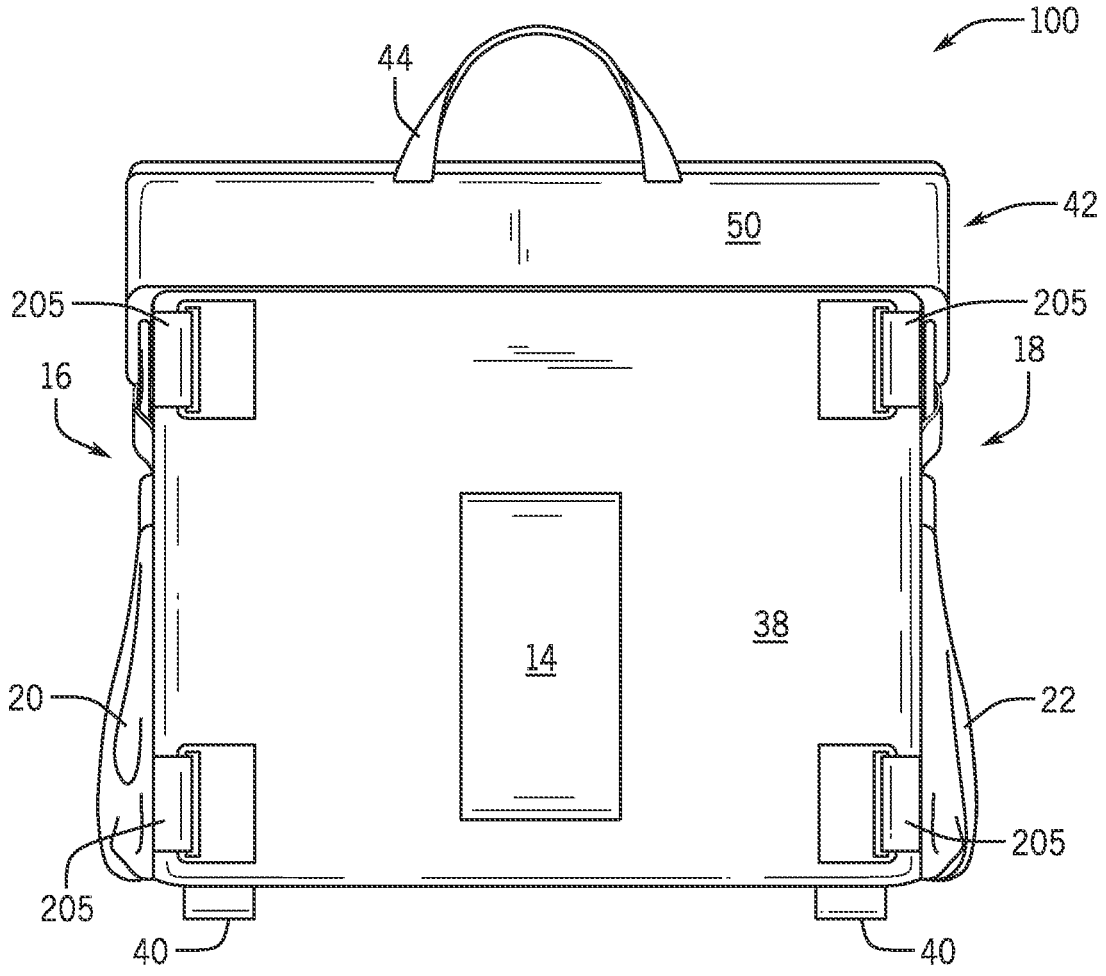
FIG. 3 is a rear view of the case of FIG. 1.
Figure 4:
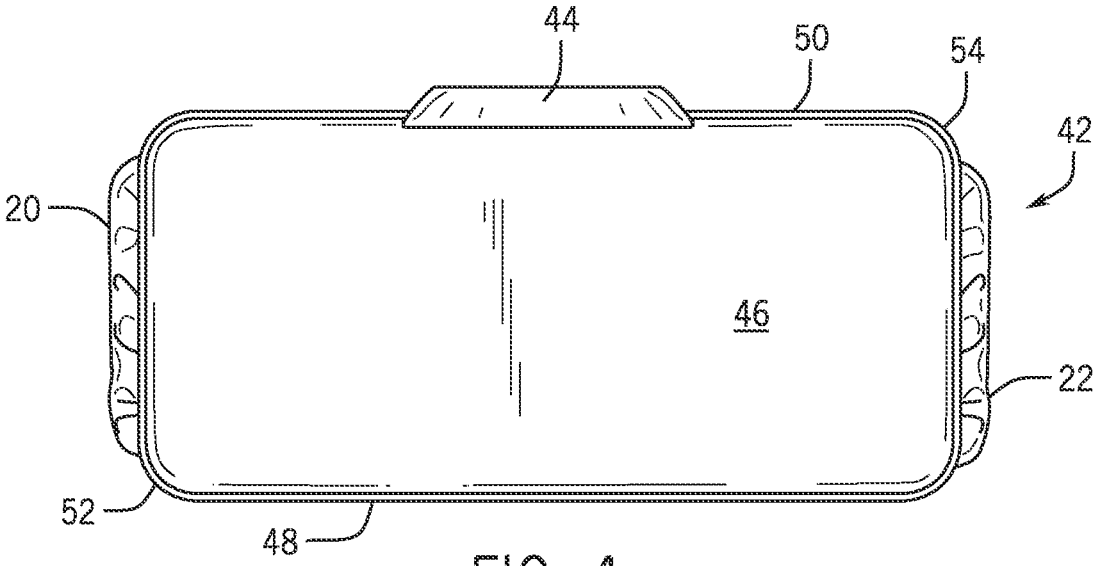
FIG. 4 is a top view of the case of FIG. 1.

As shown in FIG. 3, the back side wall 14 has a shape and dimensions substantially similar to the front side wall 12. That is, in the embodiment shown, the rear side wall 14 is generally rectangular, having a height from approximately 5.0 inches, or 5.5 inches, or 6.0 inches, or 6.25 inches to 6.5 inches, or 6.75 inches, or 7.0 inches, or 7.5 inches, or 8.0 inches and a width from approximately 5.0 inches, or 5.5 inches, or 6.0 inches, or 6.25 inches to 6.5 inches, or 6.75 inches, or 7.0 inches, or 7.5 inches, or 8.0 inches. However, in further embodiments, the shape and size of the back side wall 14 may differ depending on the shape of the bottom 12 and desired shape of the case 100.

As will be described below, the back side wall 14 is designed to be in contact with a user's body (e.g., chest, side, hip, waist, etc.). In some embodiments, therefore, the back side wall 14 may include a layer of breathable material. The breathable material may include a treatment, such as a moisture-wicking treatment, antimicrobial treatment, antifungal treatment, and/or an odor-eliminating treatment. Further, in some embodiments, the back side wall 14 may include additional padding material and/or stiffening elements in an ergonomic arrangement to make carrying the case 100 more comfortable for the user.

Figure 6:
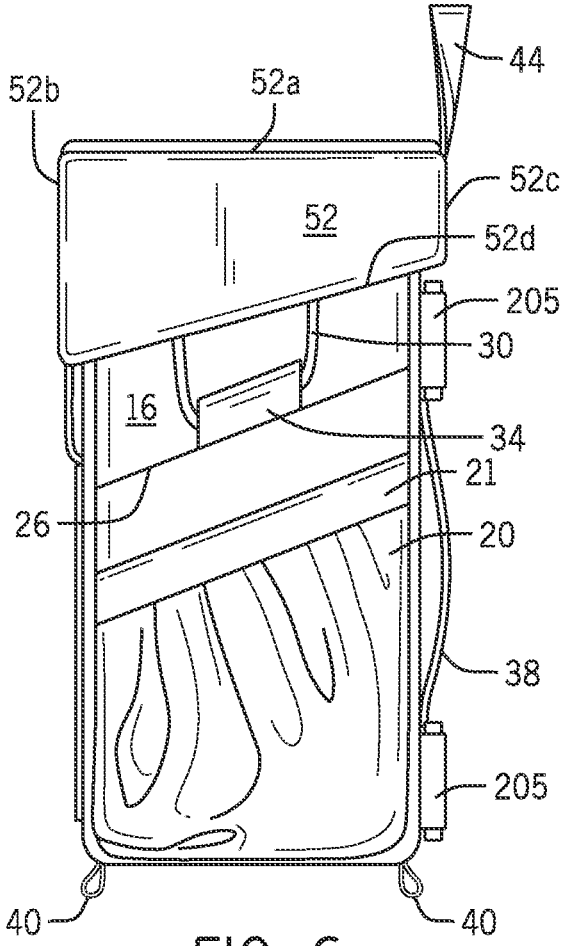
FIG. 6 is a right side view of the case of FIG. 1.
Figure 7:
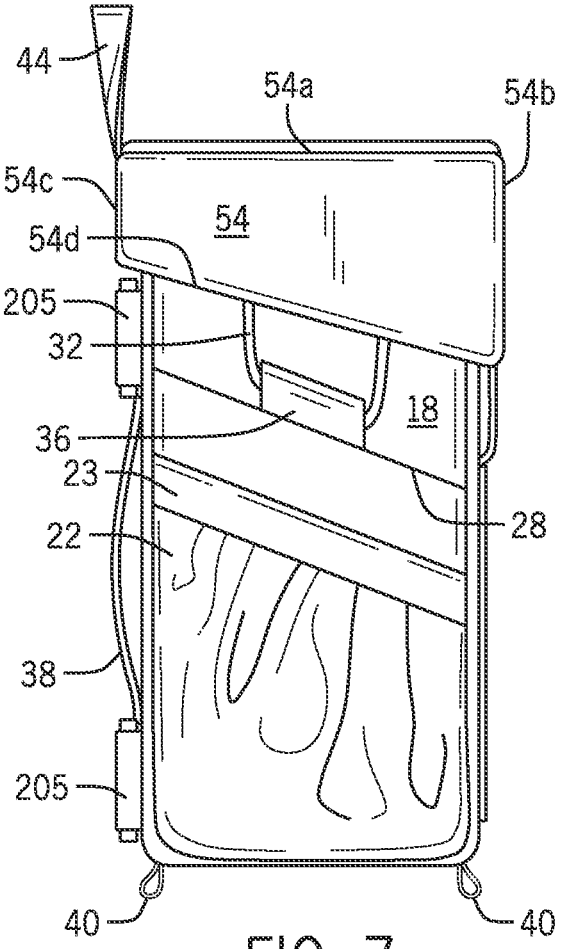
FIG. 7 is a left side view of the case of FIG. 1.

In the embodiment shown in FIGS. 3, 6 and 7, the back side wall 14 also includes a slide panel 38 and harness attachment points 205. The slide panel 38 comprises one or more flat fabric or elastic panels secured at the top and bottom edges to the back side wall 14 to form a loop with the back side wall 14. The slide panel 38 can be used to attach the case 100 to a belt or other strap for user to wear. Alternatively, the slide panel 38 may also be used to attach accessories to the case 100. In further embodiments, the back side wall 14 may include different structures, such as, for example, clasps, clips, hook-and-loop fasteners, etc., to facilitate attachment of the case 100 to a belt or strap for a user to wear or to secure accessories to the case 100.

The harness attachment points 205 are used to secure the case 100 to a harness 200 (not shown) as will be discussed with reference to FIGS. 17-18. In the embodiment shown, the harness attachment points 205 are loops or ends of chording. However, in further embodiments, the harness attachment points 205 could be any structure or device designed to secure the case 100 to a given harness.

The left and right side walls 16, 18, respectively, are generally symmetric. As shown in FIGS. 6-7, the left and right side walls 16, 18 are generally rectangular, each having a height from approximately 5.0 inches, or 5.5 inches, or 6.0 inches, or 6.25 inches to 6.5 inches, or 6.75 inches, or 7.0 inches, or 7.5 inches, or 8.0 inches and a width from approximately 3.0 inches, or 3.25 inches, or 3.5 inches, or 3.75 inches to 4.0 inches, or 4.25 inches, or 4.5 inches, or 4.75 inches, or 5.0 inches. However, in further embodiments, the shape and size of the left and right side walls 16, 18 may differ depending on the shape of the bottom 12 and desired shape of the case 100.

Each of the left and right side walls 16, 18 includes a mesh pocket 20, 22, respectively. The mesh pockets 20, 22 each have an elastic opening 21, 23 to keep the openings tight to the side walls 16, 18. The pockets 20, 22 can be used to store accessories. In the particular embodiment shown, the pockets 20, 22 are generally the width of the side walls 16, 18 with the elastic openings 21, 23 running generally diagonal across the width of the side walls 16, 18 with the highest end of the opening 21, 23 near the front side wall 12 and the lowest end of the opening 21, 23 near the back side wall 14. In further embodiments, the pockets 20, 22 may be made of a material other than mesh, such as, for example, be a solid material, and may use different openings with or without closure mechanisms. That is, in an embodiment, the openings may be loose openings. In a further embodiment, the openings may include one or more closure mechanisms such as, by way of non-limiting example, magnets, snaps, clips, hook-and-loop fasteners, drawstrings, ties, etc.

The left and right side walls 16, 18 each further include an elastic chord 30, 32 which passes through a loop 34, 36 and secures at its free ends to the lid 42, which is described in further detail below. The loop 34, 36 is secured to the respective side wall 16, 18 at a reinforcing seam 26, 28, which in the embodiment shown runs parallel to the opening 21, 23. In further embodiments, the elastic chord 30, 32 may be secured to their respective side wall 16, 18 using other means, including, for example, sewn directly to the side wall 16, 18.

As shown in FIGS. 1-4 and 6-7, the case 100 further includes a lid 42. In the embodiment shown, the lid 42 is generally rectangular in shape with a top cover 46 and four side portions 48, 50, 52 and 54 connected thereto. In particularly, the lid 42 includes two pairs of opposed side portions 48, 50 and 52, 54 connected to the top cover 46 to form the lid 42. While in the embodiment shown, the lid 42 is generally rectangular which together with the side portions 48, 50, 52, and 54 forms a lid 42 having the shape of a rectangular prism, it is appreciated that the specific shape of the lid 42 will vary to correspond to the shape of the body 5 of the case 100.

Like the body 5, the top cover 46 and side portions 48, 50, 52 and 54 are each made of a durable fabric material, or layers of such materials, which has water repellent and tear resistant properties. Preferably the durable fabric is also lightweight and makes little noise when folded or manipulated, such as the materials describe above with reference to the body 5. The top cover 46 further includes a stiffening element to provide rigidity to the lid 42 and provide some shape for the lid 42 (and particularly for the side portions 48, 50, 52 and 54) so that the lid 42 can properly secure over the base 5. In further embodiments, the side portions 48, 50, 52 and 54 may also include a stiffening element; however, as described in further detail below, it is preferable that the side portions 48, 50, 52 and 54 are able to compress under force.

In an embodiment, one of more of the top cover 46 and side portions 48, 50, 52 and 54 may further include a padding material, such as fibrous/resinous material (e.g., cotton, polyester, etc.).

As shown in FIG. 1, the lid 42 is designed such that the side portions 48, 50, 52 and 54 overlap the base 5. The top cover 46 therefore has dimensions just greater than that of the bottom 10. In an embodiment, the top cover 46 has an approximate length from 5.0 inches, or 5.5 inches, or 6.0 inches, or 6.25 inches to 6.5 inches, or 6.75 inches, or 7.0 inches, or 7.5 inches, or 8.0 inches and an approximate width from 3.0 inches, or 3.25 inches, or 3.5 inches, or 3.75 inches to 4.0 inches, or 4.25 inches, or 4.5 inches, or 4.75 inches, or 5.0 inches.

In the embodiment shown in FIGS. 2-3, the front and rear side portions 48 and 50, respectively, are shown to overlap with the base 5 along the entirety of their respectively lengths. However, in further embodiments, the rear side portion 50 does not overlap with the base 5 along the entirety of its respective length. That is, in a particular embodiment, the optical instrument stored in the case 100 may be at least partly exposed along the rear side where the rear of the lid 42 and body 5 meet. The gap between the lid 42 and the body 5 creates a location at which a user can more readily and easily grasp the lid 42 to manipulate it into an open position as discussed more thoroughly with respect to FIGS. 8-14.

As shown in FIGS. 2-3, the front and rear side portions 48 and 50, respectively, are rectangular while the right and left side portions 52 and 54, respectively, are trapezoidal or, in further embodiments, right trapezoidal. As a result, the front side portion 48 is larger than the rear side portion 50. As will be described in further detail with respect to FIGS. 9-14, the configuration of the lid 42 permits the lid 42 to be moved downward along the front side wall 10 of the base 5 with little to no obstruction of the opening (not shown). In the particular embodiment shown, the front and rear side portions 48, 50 each have approximate length from 5.0 inches, or 5.5 inches, or 6.0 inches, or 6.25 inches to 6.5 inches, or 6.75 inches, or 7.0 inches, or 7.5 inches, or 8.0 inches. The front side portion 48 has an approximate height from 2.5 inches, or 2.75 inches, or 3.0 inches to 3.25 inches, or 3.5 inches, or 3.75 inches, or 4.0 inches. The rear side portion 50 has a height less than that of the front side portion 48, and preferably from 15% to 50% less than that of the front side portion 48. In an embodiment, the rear side portion 50 has an approximate height from 1.0 inches, or 1.25 inches, or 1.5 inches, or 1.75 inches to 2.0 inches, or 2.25 inches, or 2.5 inches, or 2.75 inches, or 3.0 inches.

Because the right and left side portions 52 and 54 are trapezoidal, the length of each of their sides is different. Generally, the upper length 52 *a*, 54*a* of the side portions 52, 54 corresponds to the width of the top cover 46. That is, in an embodiment, the upper length 52 *a*, 54*a* of the side portions 52, 54 is from 3.0 inches, or 3.25 inches, or 3.5 inches, or 3.75 inches to 4.0 inches, or 4.25 inches, or 4.5 inches, or 4.75 inches, or 5.0 inches. The long side length 52*b*, 54*b* of the side portions 52, 54 corresponds to the height of the front side portion 48. That is, the long side length 52*b*, 54*b* of the side portions 52, 54 is from 2.5 inches, or 2.75 inches, or 3.0 inches to 3.25 inches, or 3.5 inches, or 3.75 inches, or 4.0 inches. The short side lengths 52*c*, 54*c* of the side portions 52, 54 are less than the height of the front side portion 48, and preferably from 15% to 50% less than the height of the front side portion 48. In an embodiment, short side lengths 52*c*, 54*c* are approximately from 1.0 inches, or 1.25 inches, or 1.5 inches, or 1.75 inches to 2.0 inches, or 2.25 inches, or 2.5 inches, or 2.75 inches, or 3.0 inches. In view of the foregoing, it will be appreciated that the diagonal lengths 52*d*, 54*b* of the sides 52, 54 will vary depending on the measurements of the other three sides, but generally, the diagonal lengths 52*d*, 54*d* are longer than the upper lengths 52 *a*, 54*a*. In a particular embodiment, the diagonal lengths 52*d*, 54*d* are from 3.0 inches, or 3.25 inches, or 3.5 inches, or 3.75 inches to 4.0 inches, or 4.25 inches, or 4.5 inches, or 4.75 inches, or 5.0 inches.

As shown in FIGS. 6-7, the elastic chords 30, 32 are secured to the inside of the side portions 52, 54, and preferably on the inside of the side portions 52, 54. An elastic band 56 is also provided to connect the lid 42 via the front side portion 48 and the front side wall 10, as shown in FIGS. 1-2. That is, the elastic band 56 helps keep the lid 42 in the closed position by providing tension in the downward direction on the front of the lid 42. The elastic band 56 is secured to the inside of the front side portion 48 of the lid 42 and the outside of the front side wall 10. In a particular embodiment, such as shown in FIGS. 1-2, the elastic band 56 is secured to the outside of the front side wall 10 between the front side wall 10 and the attachment panel 24.

The lid 42 also includes a loop 44. The loop 44 functions as a handle for a user to grab to assist in opening the case 100 and manipulating the lid 42 to the open position, as shown in FIGS. 8-15. In the embodiment shown, the loop 44 is secured to the lid 42 at the junction between the top cover 46 and the rear side portion 50.

As shown in FIGS. 1-7, the body 5 of the case 100 may include a variety of additional structures to enable a user to carry additional accessories, or even personal belongings. For example, the body 5 further includes a plurality of attachment loops 40 configured to secure additional items by way of clips, ties, carabiners, etc. In further embodiments, one or more additional pockets or pouches may be provided on the outside of the body 5, or even lid 42.

Figure 13:
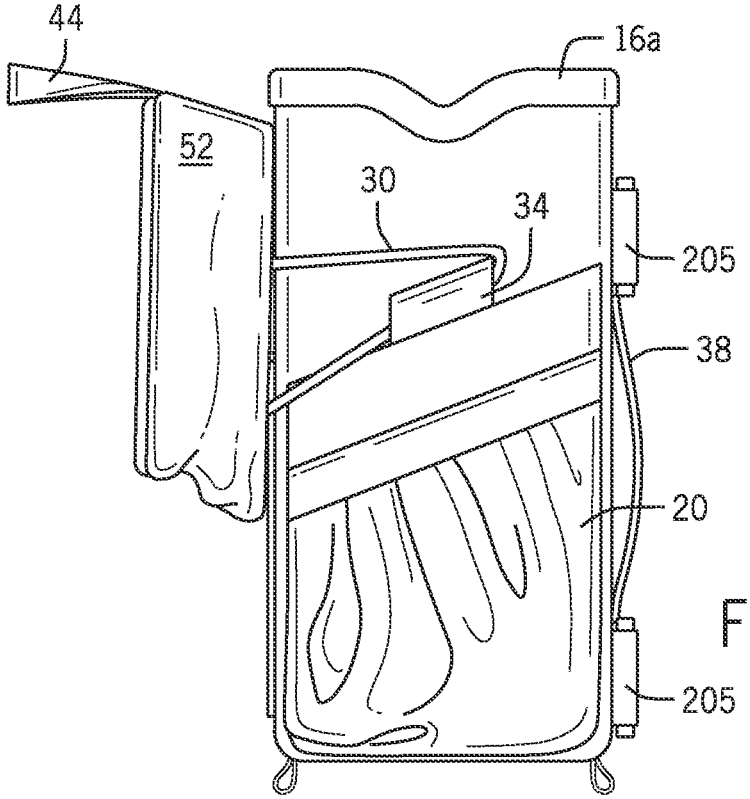
FIG. 13 is a right side view of the case of FIG. 8.
Figure 14:
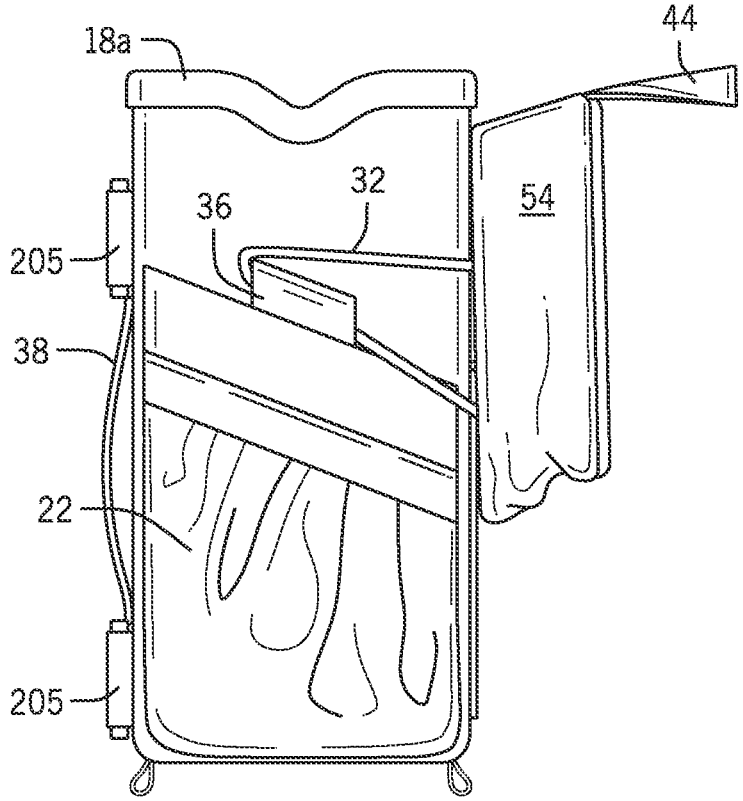
FIG. 14 is a left side view of the case of FIG. 8.

Turning now to FIGS. 8-14, the case 100 is shown with the lid 42 in the open position. That is, the lid 42 has been manipulated along the front side wall 12 such that the top cover 46 is approximately parallel with the front side wall 12 and held against the front side wall 12 by the elastic chords 30, 32, and the elastic band 56 (not shown) is loose (no tension). Because the side portions 48, 50, 52 and 54 are made of a fabric material with little to no stiffening element, the side portions 48, 50, 52 and 54 can be compressed against the front side wall 12, such as shown in FIGS. 13 and 14. The compression of the lid 42 against the front side wall 12 limits or prevents debris and water (e.g., rain) from being captured by the lid 42 while in the open position.

The inside surface (not shown) of the top cove 46 is generally flat and in some embodiments includes a padding material and/or covering to prevent damage to the optical instrument contained in the cavity 60. For example, in some embodiments, in addition to a stiffening element contained in the top cover 46, the inside surface of the top cover 46 may additionally include a cotton or polyester fill layer. In further embodiments, the inner surface of the top cover 46 may be lined with a material which does not scratch glass or optical lenses. Further, as shown in FIG. 11, the cavity 60 of the case may likewise include a padding material and/or lining to prevent damage to the optical instrument.

Figure 11:
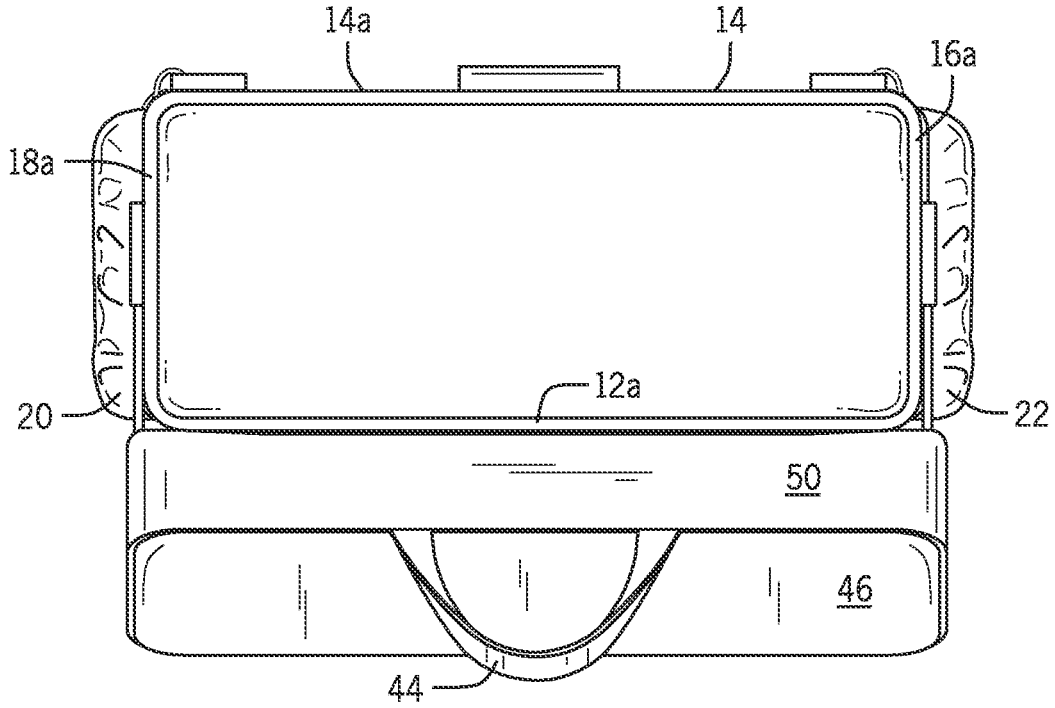
FIG. 11 is a top view of the case of FIG. 8.
Figure 12:
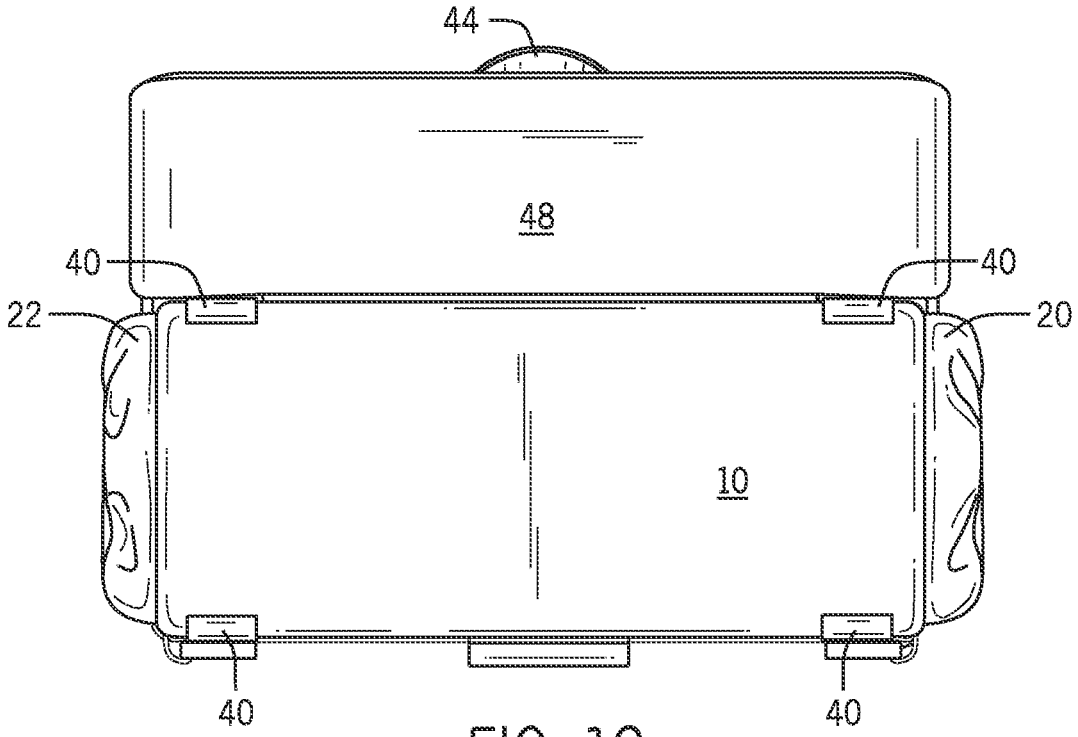
FIG. 12 is a bottom view of the case of FIG. 8.

As shown in FIG. 11, the cavity 60 itself is a simple single cavity 60. However, in further embodiments, the cavity 60 may have contouring specific to a desired optical instrument, additional structure and/or padding material to cushion or better secure a desired optical instrument, and/or contain divisions or additional compartments for storing and carrying different optical instruments and related accessories. In still further embodiments, the cavity 60 may include pockets or similar dividers for organizational purposes. Likewise, the inside of the lid 42 (not shown) may include contouring, additional structure and/or padding material to cushion or better secure a desired optical instrument, assist in securing the lid 42 (not shown) to the body 5 of the case 100, and/or assist in aiding a user in moving the lid 42 (e.g., from a closed position to an open position and/or vice versa). For example, in an embodiment, the inside of the lid 42 (not shown) may include a lip or other projection or structure along all or a portion of its edges to help keep the lid 42 (not shown) in place when in a closed position.

Figure 8:
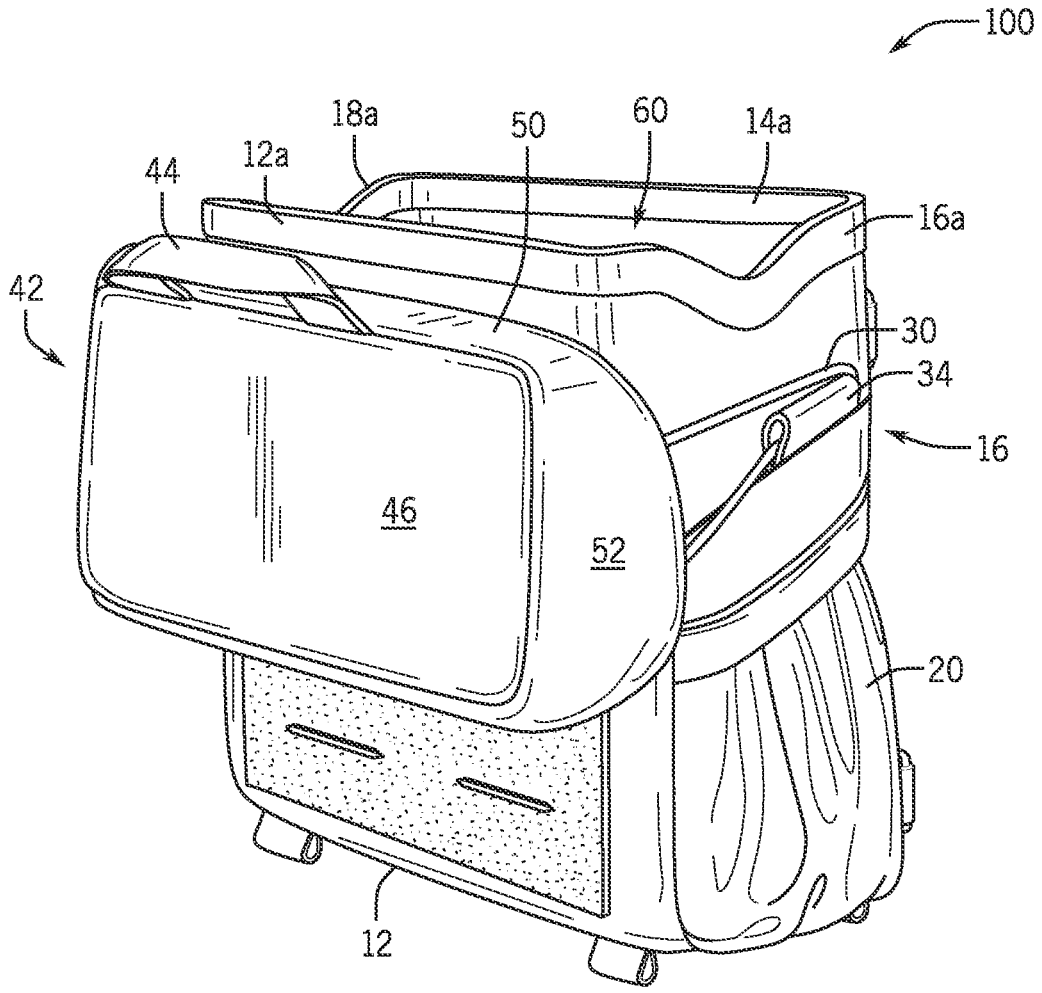
FIG. 8 is an isometric view of the case of FIG. 1 with the cover in the open position.
Figure 9:
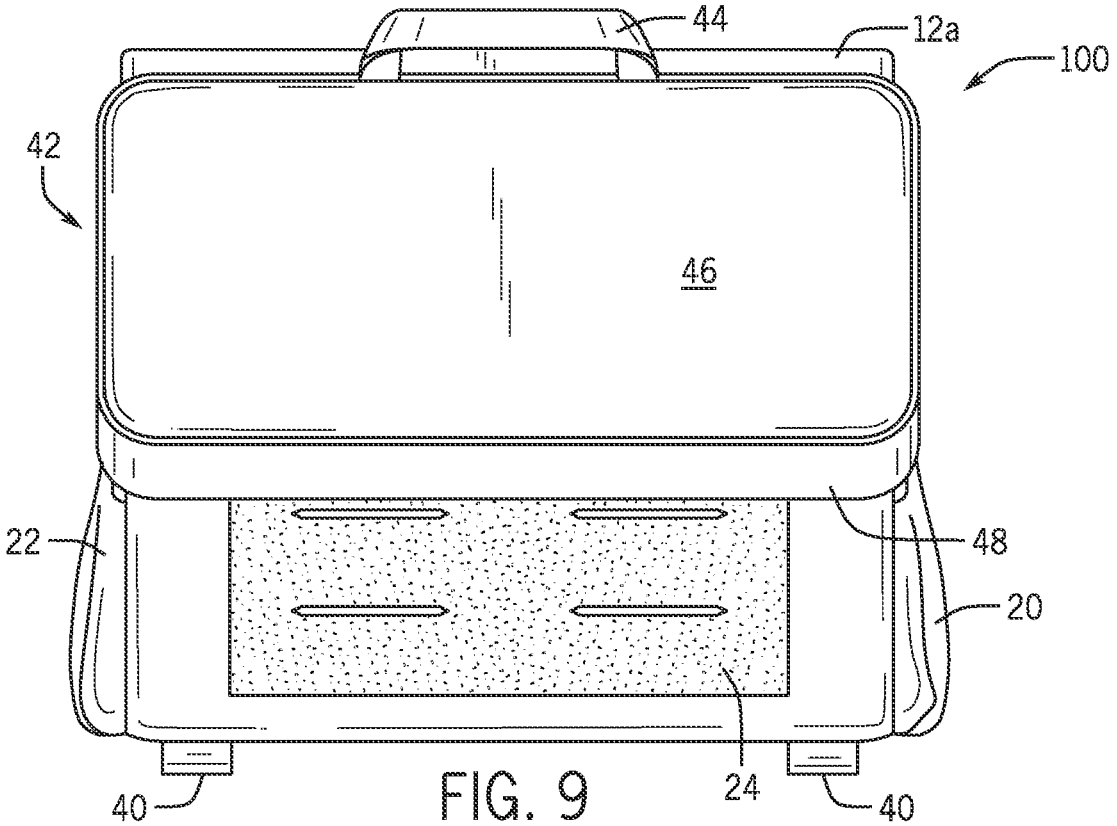
FIG. 9 is a front view of the case of FIG. 8.
Figure 10:
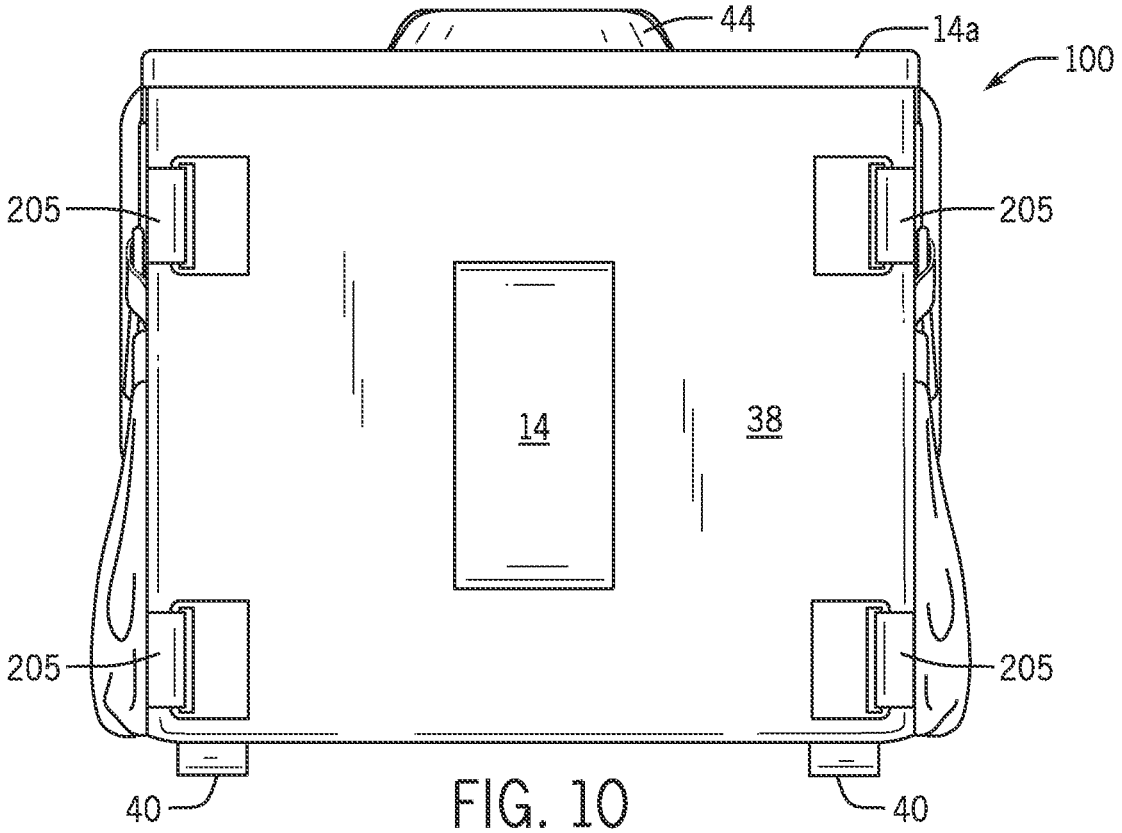
FIG. 10 is a rear view of the case of FIG. 8.

Also shown in FIGS. 8-14, and perhaps best shown in FIGS. 8 and 11, are the upper edges 12 *a*, 14*a*, 16*a* and 18*a* of side walls 12, 14, 16 and 18. In the embodiment shown, the upper edges 12 *a*, 14*a*, 16*a* and 18*a* are reinforced and, in some embodiments, may include a stiffening element (e.g., plastic frame). Reinforcing or stiffening the upper edges 12 *a*, 14*a*, 16*a* and 18*a* makes it easier for a user to remove or replace an optical instrument in the cavity 60. In the embodiment shown, upper edges 12 *a*, 14*a* are straight edges and mate with the inside surface of the top cover 46 along the length of the upper edges 12 *a*, 14*a* to provide a secure fit between the lid 42 and the body 5. In contrast, upper edges 16*a*, 18*a* are contoured and have a dip, or indentation, partway along the upper edges 16*a*, 18*a*, as shown in FIGS. 13 and 14. This contouring facilitates the removal and insertion of an optical instrument into/out of the cavity 60. Further, in some instances, it may be beneficial for a user to be wearing an optical instrument, e.g., binoculars, with a strap around the user's neck, while still carrying the optical instrument in the case 100, e.g., for protection. The indentations long the upper edges 16*a*, 18*a* allow the neck strap of the optical instrument to properly lie around the user's neck. Indeed, in some embodiments depending on the particular design of the case 100 and the particular optical instrument, the lid 42 may remain in closed position while the neck strap remains around a user's neck with the neck strap projecting through the indentations around the respective side portions 52, 54.

Figure 15:
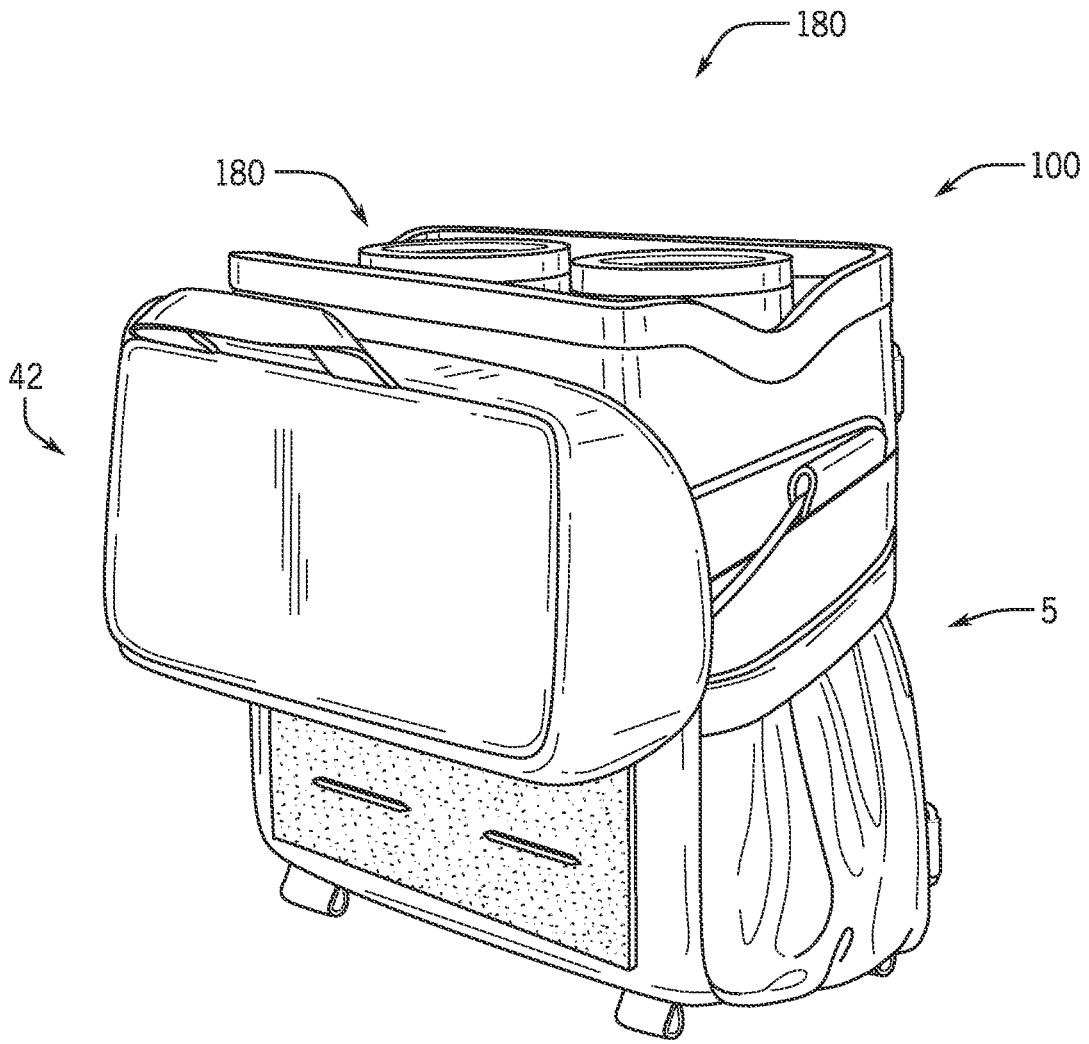
FIG. 15 is an isometric view of the case of FIG. 8 with binoculars inside.

FIG. 15 illustrates the case 100 with the lid 42 in the open position along the front side wall 12 of the body 5 and an optical instrument 180, in this case, binoculars, contained within the cavity 60 (not shown). In the embodiment illustrated, the optical instrument 180 sits in the cavity 60 (not shown) approximately flush or lower than the upper edges 12 *a*, 14*a*, 16*a*, and 18*a*. In this way, the optical instrument 180 remains somewhat protected when the lid 42 is in the open position. Moreover, when the optical instrument 180 does not extend beyond the upper edges 12 *a*, 14*a*, 16*a* and 18*a*, the lid 42, and particularly the top cover 46 of the lid 42 sits against, so as to be in physical contact with, the upper edges 12 *a*, 14*a*, 16*a* and 18*a*. This limits physical contact between the optical instrument 180 and the lid 42, as well as creates a better barrier around the cavity 60 to limit debris and moisture from entering the cavity 60 when the lid 42 is in the closed position.

In contrast, in embodiments in which the optical instrument 180 protrudes above the upper edges 12 *a*, 14*a*, 16*a* and 18*a*, the lid 42, and particularly the top cover 46 of the lid 42, physically contacts the optical instrument 180 and sits against the optical instrument 180 rather than the upper edges 12 *a*, 14*a*, 16*a* and 18*a*. As a result, the lid 42 may not sit securely, e.g., may wobble and, in some embodiments, the side portions 48, 50, 52 and 54 may not overlap with the body 5 of the case 100. In any event, when the optical instrument 180 protrudes above the upper edges 12 *a*, 14*a*, 16*a* and 18*a*, the lid 42 does not form as tight a closure around the body 5 of the case 100, creating a greater chance that debris and/or moisture may enter the case 100.

Figure 16:
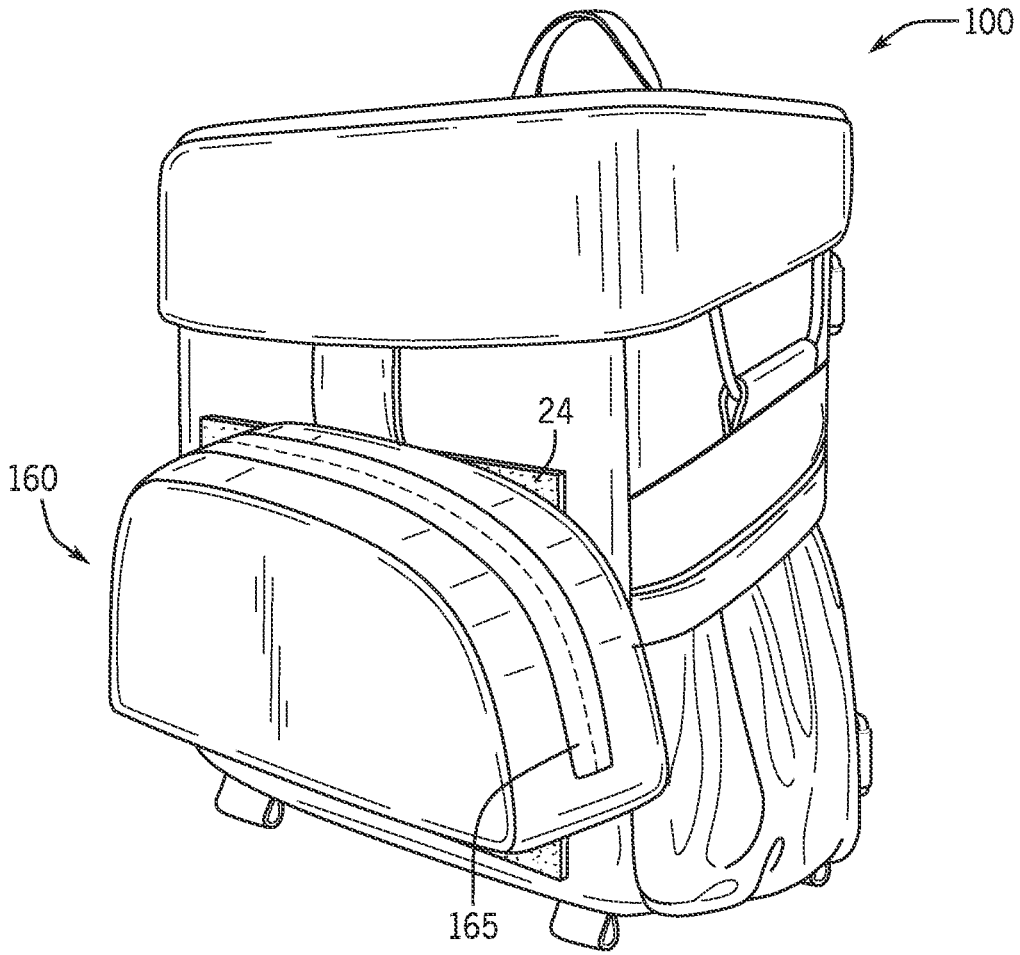
FIG. 16 is an isometric view of the case of FIG. 1 with the accessory pouch of FIG. 16 attached.

FIG. 16 shows the case 100 in use with an optional accessories case 160. In the embodiment shown, the accessory case 160 is attached to the attachment panel 24 using the hook-and-loop type attachment. However, in further embodiments, the accessory case 160 may be secured to the attachment panel 24 using buckles, straps, ties or other similar structures passed through the slits 25, or attached to the case 100 with structures engaging one or more attachment loops 40.

In the embodiment shown, the accessory case 160 has a silent zipper feature 165 to open and close the accessory case 160 Silent zippers are known in the art and include a number of different structures and mechanisms for quieting the zipping sound. In other embodiments, the accessory case 160 may include a drawstring closure, clips, snaps, hook-and-loop closure, or any other style of closure known in the art.

Figure 17:
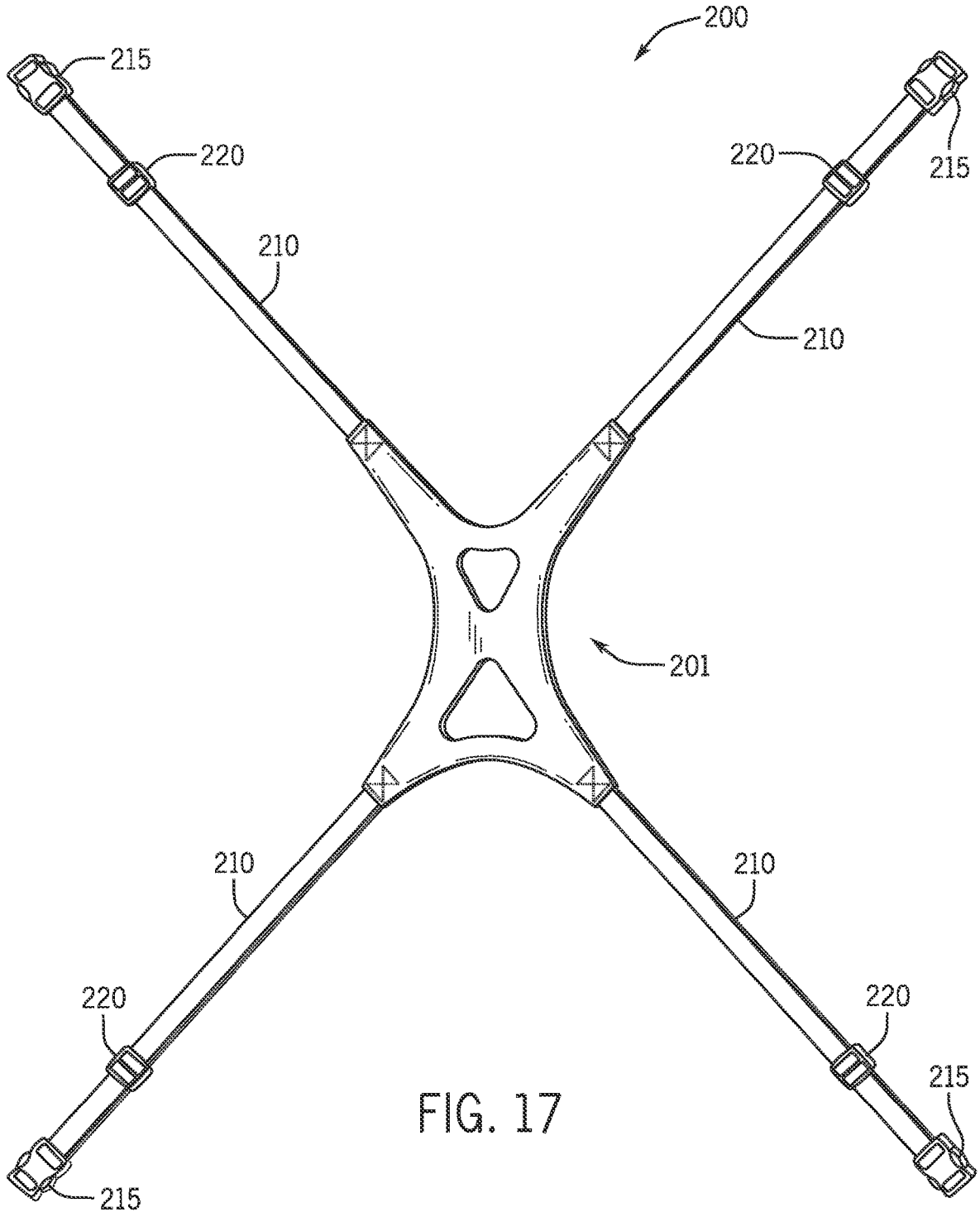
FIG. 17 illustrates a harness for use with a case in accordance with embodiments of the present disclosure.

FIG. 17 illustrates an exemplary harness 200 for use with a case 100 in accordance with embodiments of the present disclosure. The harness 200 includes a back plate portion 201 with four straps 210 extending outward from the back plate portion 201. In the embodiment shown, the back plate portion 201 has generally a figure-eight configuration; however, in further embodiments, the back plate portion 201 may be a solid portion and/or have any shape or size from which the four straps 210 may extend.

Because the back plate portion 201 will be in physical contact (directly or indirectly) with a user's back, in a preferred embodiment the back plate portion 201 is made of a breathable, moisture wicking material. In further embodiments, the back plate portion 201 may include one or more stiffening elements to provide some rigidity to the back plate portion 201 and better support its load, e.g., the case and optical instrument. In still further embodiments, the back plate portion 201 may include one or more padding materials for the comfort of the user.

Each strap 210 is secured to the back plate portion 201 with reinforced stitching. In other embodiments, the straps 210 may connect with the back plate portion 201 in any manner which facilitates a secure connection when carrying a load. Further, each strap 210 has a case attachment structure 215 at its end for attachment to the harness attachment points 205 (not shown) of the case 100 (not shown) and a length adjustment structure 220. It will be appreciated that, while the case attachment structures 215 are shown as a buckle with the strap woven through, and the length adjustment structures 220 are shown as a slide or strap adjuster, in further embodiments, the case attachment structures 215 and length adjustment structures 220 may take any form capable of fulfilling the attachment and adjustment roles.

Figure 18:
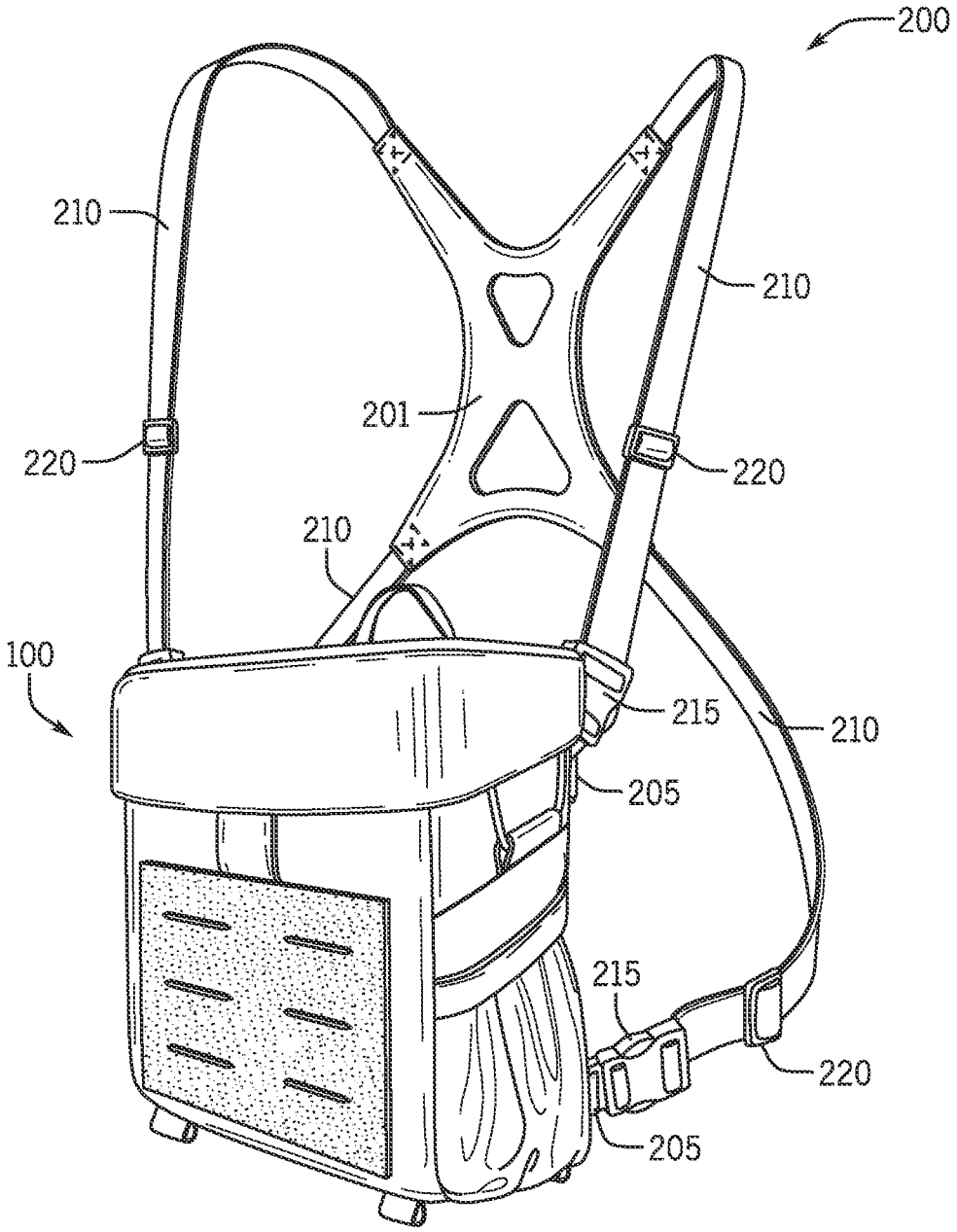
FIG. 18 is an isometric view of the case of FIG. 1 connected with the harness of FIG. 17.
Figure 19:
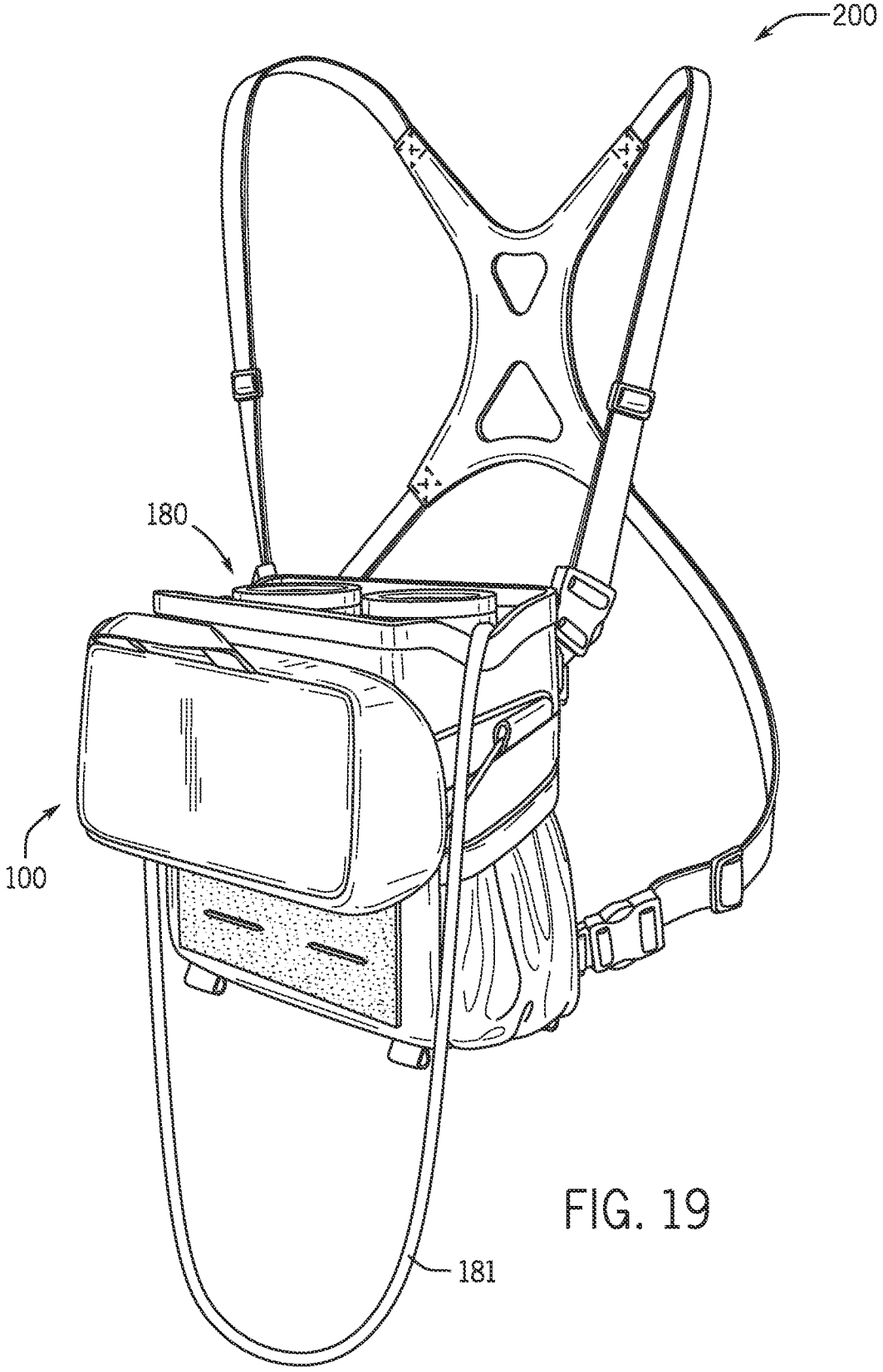
FIG. 19 is an isometric view of the case and harness of FIG. 18 with the cover in an open position.
Figure 20:
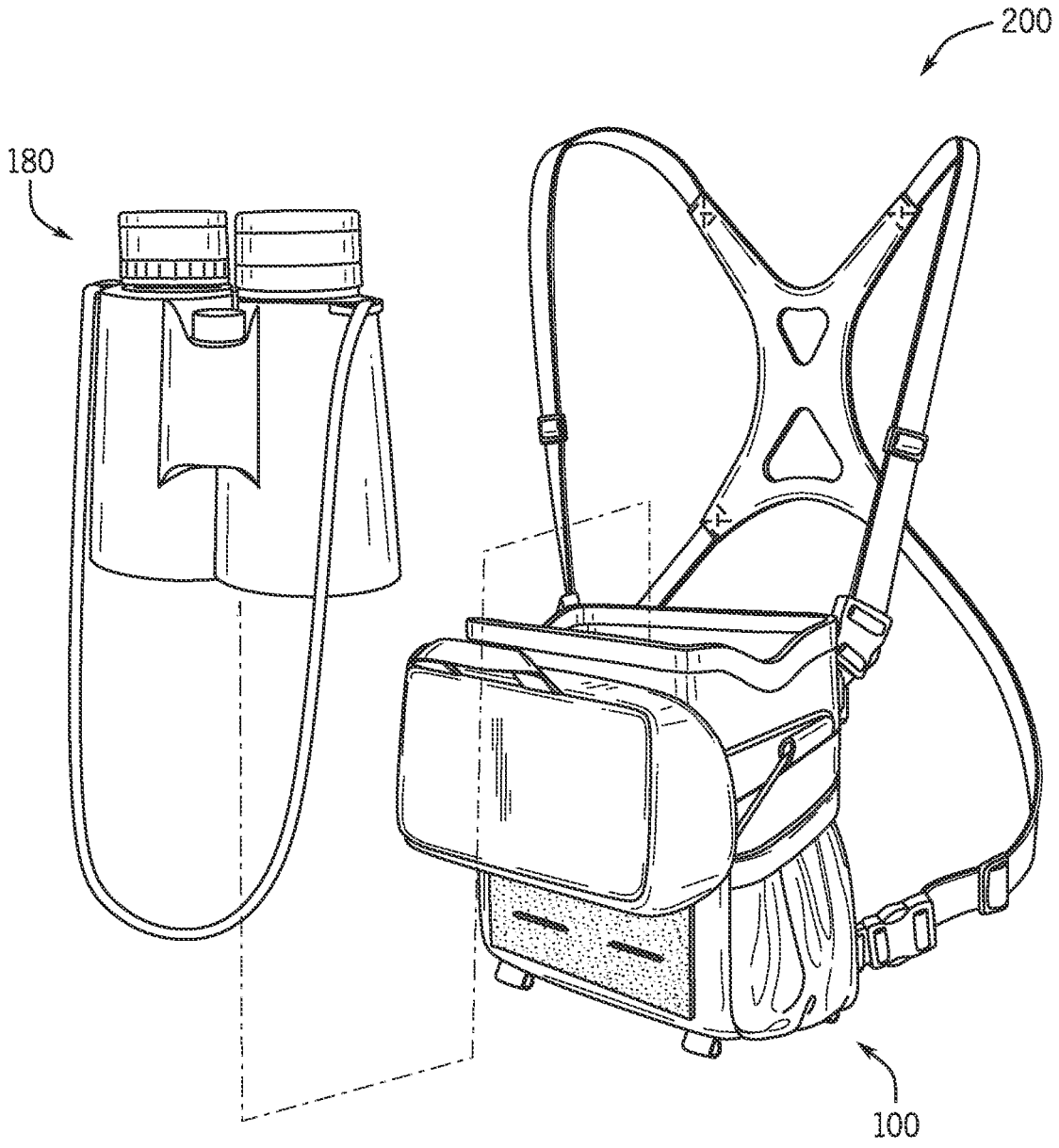
FIG. 20 is an isometric view of the case and harness of FIG. 19 with the cover in an open position and the binoculars removed from the case.

FIG. 18 illustrates the case 100 attached to a harness 200. Each of the straps 210 is connected (via the attachment structures 215) to the case 100 at harness attachment points 205, with the lid 42 of the case 100 in the closed position. FIG. 19 illustrates the case 100 attached to the harness 200 with the lid 42 in the open position. The tether 181 of the optical instrument 180 is hanging out of the case 100 at the indentations in upper edges 16*a* and 18*a* (not shown) such that the lid 42 could be closed over the tether 181, if desired. FIG. 20 illustrates the case 100 attached to the harness 200 with the lid 42 in the open position and the optical instrument 180 removed from the case 100 and ready for use.

Figure 21:
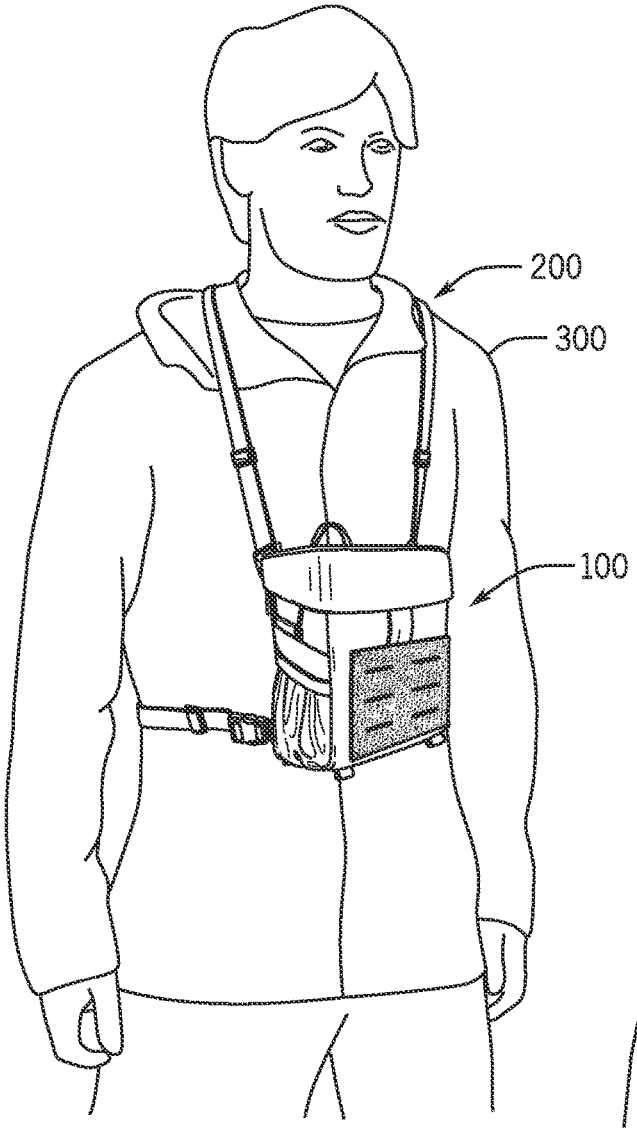
FIG. 21 is an isometric view of the case and harness of FIG. 18 on a person in accordance with embodiments of the present disclosure.
Figure 22:
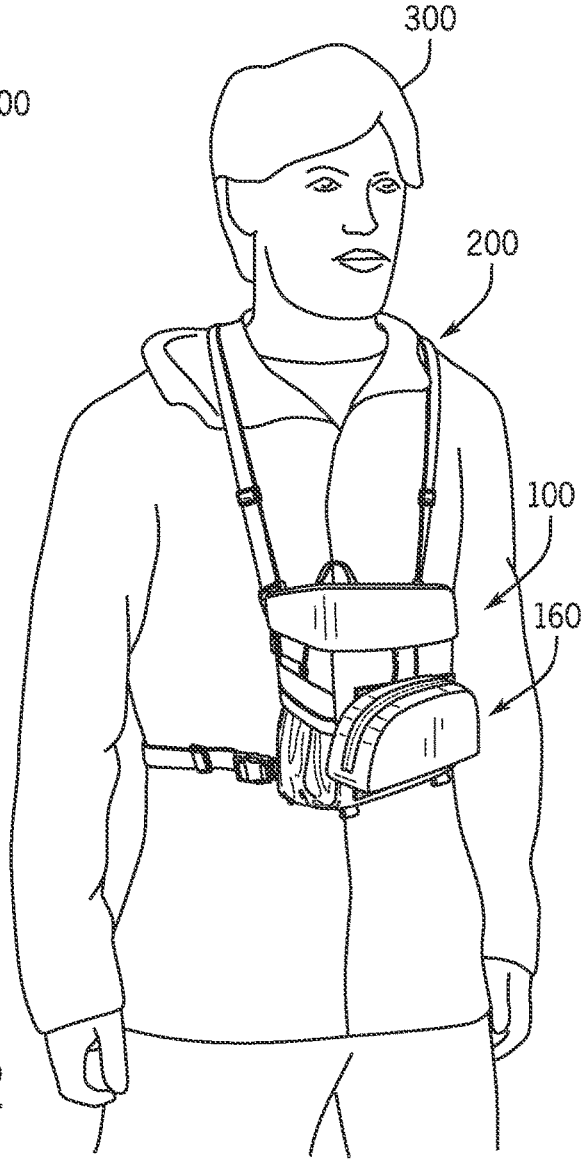
FIG. 22 shows the case and harness of FIG. 21 with the accessory pouch included.

FIGS. 21-22 show the case 100 and harness 200 in use on a person 300. In the embodiments shown, the back plate portion 201 (not shown) of the harness 200 is against the user's back, with the lower straps 210 (not labeled) wrapped around the user's waist and secured to the case 100. The upper straps 210 (not labeled) go up and around the user's shoulders and connect to the case 100. It will be appreciated that the lower straps 210 (not labeled) which wrap around the user's waist connect to the lower pair of harness attachment points 205 on the case 100 while the upper straps 210 which go up and around the user's shoulder connect to the upper pair of harness attachment points 205 on the case 100.

As shown in FIGS. 18-22, the case 100 is positioned with the harness 200 such that the rear side wall 14 (not shown) of the case is against the user's 300 torso. As a result, the loop 44 (not labeled) of the lid 42 (not labeled) is also nearer the user's 300 torso and the lid 42 (not labeled) opens away from the user 300. By opening away from the user 300, the lid 42 (not labeled) does to create additional bulk between the case 100 and the user 300 and further does not obstruct access the user's 300 access to the cavity 60 (not shown) when the lid 42 (not labeled) is in the open position. Moreover, as shown in FIGS. 19-20, and as described previously, when the lid 42 (not labeled) is in the open position, the elastic chords 30, 32 (not shown) pull the lid 42 (not labeled) against the front side wall 12 (not labeled) so as to compress the lid 42 (not labeled). Compressing the lid 42 (not labeled) against the front side wall 12 (not labeled) reduces bulk extending from the front of the case 100 and keeps the cavity formed by the opened lid 42 (not labeled) from collecting dust, debris, moisture and other particulate material. When an accessory case 160 is used on the front side wall 12 (not labeled), as shown in FIG. 22, compression the lid 42 (not labeled) against the front side wall 12 (not labeled) also serves to increase the accessibility of the accessory case 160.

Figure 23:
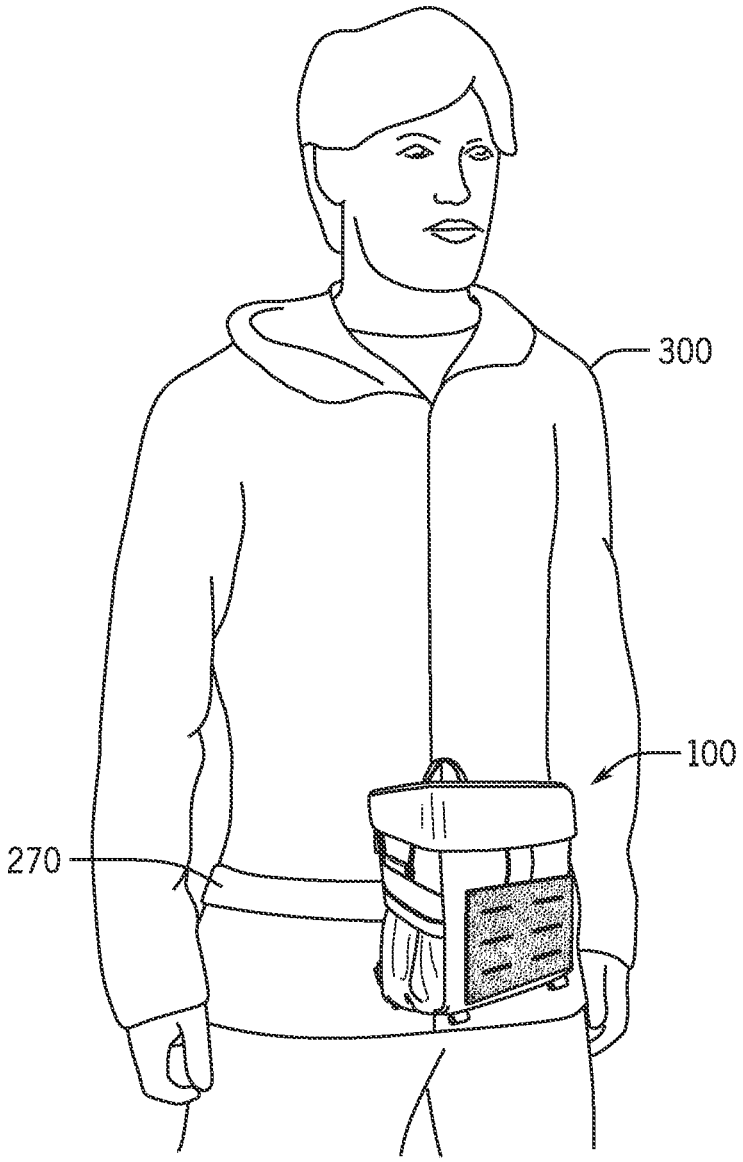
FIG. 23 shows the case of FIG. 1 worn on a belt in accordance with embodiments of the present disclosure.

While the embodiments described above with reference to FIGS. 17-22 describe the use of the case 100 in combination with a harness 200, in further embodiments, the case 100 can be secured or attached to a user 300 via other means, such as a belt or waist strap 270 as shown in FIG. 23. In the embodiment shown in FIG. 23, the belt or waist strap 270 is passed through the slide panel 38 (see FIG. 3) and tightened around the user's 300 waist. In further embodiments, the case 100 can be attached or secured in the same manner to a cross-body strap or bag, backpack straps, chest strap, or any other strap-like structure worn on the user's 300 body.

Various modifications and variations of the described compositions and methods of the invention will be apparent to those skilled in the art without departing from the scope and spirit of the invention. One skilled in the art will recognize at once that it would be possible to construct the present invention from a variety of materials and in a variety of different ways. Although the invention has been described in connection with specific preferred embodiments, it should be understood that the invention should not be unduly limited to such specific embodiments. While the preferred embodiments have been described in detail, and shown in the accompanying drawings, it will be evident that various further modification are possible without departing from the scope of the invention as set forth in the appended claims. Indeed, various modifications of the described modes for carrying out the invention which are obvious to those skilled in marksmanship, computers or related fields are intended to be within the scope of the following claims.

What is claimed is:

1. A optical instrument case comprising:

a body having a bottom, a front side wall, a rear side wall, a left side wall and a right side wall, a lid having a top cover, and two pairs of oppositely disposed side portions, wherein the lid has a closed position and an open position, and wherein the top cover is in contact with at least a portion of the front side wall, and further wherein the lid is compressed against the front side wall when in the open position.

2. The optical instrument case of claim 1, wherein the body is a rectangular prism.

3. The optical instrument case of claim 1, wherein each of the left side wall and right side wall has a height from 5.0 inches to 8.0 inches.

4. The optical instrument case of claim 1, wherein the two pairs of oppositely disposed side portions comprises a front side portion, a rear side portion, a left side portion, and a right side portion.

5. The optical instrument case of claim 4, wherein the front side portion has a height greater than that of the rear side portion.

6. The optical instrument case of claim 5, wherein the left side portion and right side portion are trapezoidal.

7. The optical instrument case of claim 1, wherein the rear side wall includes a plurality of harness attachment points.

8. The optical instrument case of claim 1, wherein the rear side wall further includes a slide panel.

9. The optical instrument case of claim 1, further including a harness connected to at least one of the side walls.

* * * * *